US012398619B2

(12) United States Patent
Chevallier et al.

(10) Patent No.: US 12,398,619 B2
(45) Date of Patent: Aug. 26, 2025

(54) SINGLE-TRIP DEPLOYMENT AND ISOLATION USING A BALL VALVE

(71) Applicant: Halliburton Energy Services, Inc., Houston, TX (US)

(72) Inventors: Francois Chevallier, Dhahran (SA); Ibrahim El Mallawany, Alkhobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 325 days.

(21) Appl. No.: 18/115,305

(22) Filed: Feb. 28, 2023

(65) Prior Publication Data

US 2023/0203914 A1 Jun. 29, 2023

Related U.S. Application Data

(62) Division of application No. 17/022,915, filed on Sep. 16, 2020, now Pat. No. 11,613,965.

(51) Int. Cl.

| | |
|---|---|
| ***E21B 34/10*** | (2006.01) |
| ***E21B 34/06*** | (2006.01) |
| ***E21B 34/14*** | (2006.01) |
| ***E21B 34/16*** | (2006.01) |

(52) U.S. Cl.

CPC ..... *E21B 34/10* (2013.01); *E21B 34/063* (2013.01); *E21B 34/14* (2013.01); *E21B 34/16* (2013.01); *E21B 2200/04* (2020.05)

(58) Field of Classification Search

CPC .... E21B 34/10; E21B 34/063; E21B 2200/04; E21B 17/06

See application file for complete search history.

(56) References Cited

U.S. PATENT DOCUMENTS

| | | | |
|---|---|---|---|
| 4,256,282 | A | 3/1981 | Goldschild et al. |
| 8,684,099 | B2 | 4/2014 | Azimi et al. |
| 10,519,744 | B2 | 12/2019 | Randle |
| 11,028,653 | B2 | 6/2021 | El Mallawany et al. |
| 2010/0293989 | A1 | 11/2010 | Buttner et al. |

(Continued)

FOREIGN PATENT DOCUMENTS

| | | |
|---|---|---|
| CN | 205225189 | 5/2016 |
| CN | 104864162 | 5/2017 |
| GB | 2409694 | 7/2005 |

OTHER PUBLICATIONS

International Search Report and Written Opinion for Application No. PCT/US2020/053072, dated May 27, 2021.

(Continued)

*Primary Examiner* — Cathleen R Hutchins

(74) *Attorney, Agent, or Firm* — Scott Richardson; C. Tumey Law Group PLLC

(57) ABSTRACT

A downhole deployment and isolation system may be used to deploy a completion string, service the well, and isolate the lower completion string, optionally in a single trip. The lower completion string may be run into the well with a valve in an open condition, such as a ball valve propped open by a mandrel. The mandrel may be operable to both disconnect the work string from the lower completion string and to close the valve upon disconnecting such as by removing the mandrel from the ball. The valve may be remotely reopened with fluid pressure form surface.

16 Claims, 7 Drawing Sheets

(56) References Cited

U.S. PATENT DOCUMENTS

| | | | | |
|---|---|---|---|---|
| 2010/0300702 | A1* | 12/2010 | Andrews | E21B 34/14 166/373 |
| 2013/0075108 | A1* | 3/2013 | Frisby | E21B 34/14 166/177.5 |
| 2015/0021021 | A1 | 1/2015 | Merron et al. | |
| 2017/0101852 | A1* | 4/2017 | Hawkins, III | E21B 21/10 |
| 2018/0179847 | A1 | 6/2018 | Derryberry et al. | |
| 2019/0153788 | A1 | 5/2019 | El Mallawany et al. | |

OTHER PUBLICATIONS

GCC Examination Report for Application No. GC 2020-40648 dated Dec. 31, 2021.
Office Action Summary for U.S. Appl. No. 17/022,915 dated Sep. 12, 2022.
Notice of Allowance for U.S. Appl. No. 17/022,915 dated Nov. 30, 2022.

* cited by examiner

SINGLE-TRIP DEPLOYMENT AND ISOLATION USING A BALL VALVE

CROSS-REFERENCE TO RELATED APPLICATIONS

This application is a divisional of U.S. patent application Ser. No. 17/022,915, filed Sep. 16, 2020, which is incorporated by reference in its entirety.

BACKGROUND

Wells are often constructed for the potential recovery of hydrocarbons such as oil and gas. Constructing a productive well with the potential for economic recovery is challenging, time-consuming, and expensive. Typically, a well may be drilled with a drill bit at the lower end of a string of tubular drill pipe that is progressively assembled to reach the desired well depth, which may be thousands of feet deep and follow a complex well plan. After drilling, a string of relatively large diameter tubular casing may be lowered into the wellbore and secured by circulating cement downhole and through an annulus between the casing and formation. This casing string reinforces the wellbore and may be perforated at selected depths and intervals for extracting hydrocarbon fluids from a production zone(s) of the formation. The well may be stimulated by sealing off and delivering fluid to selected production zones. Then, a production tubing string may be run into the well to the production zone, protecting the casing and providing a flow path to a wellhead through which the oil and gas can be produced.

Although summarized succinctly, each of these stages of well construction can be very complex, costly, and involve a great deal of effort and energy, with no guarantee of economic recovery of hydrocarbons. Much of the cost of drilling and maintaining a well is related to the amount of time and equipment involved. Each trip to deploy or retrieve equipment from the wellbore, or to service, replace, or repair downhole equipment, can significantly increase the overall cost. Additionally, each time downhole equipment is placed into service in the wellbore or retrieved from the wellbore, there is potential for the wellbore and/or the equipment to be damaged, with the costs for repairing such damage increasing due to the downtime of the wellbore. Thus, one of the myriad aspects of ongoing innovation in the field is directed to minimizing trips, minimizing downtime between trips, and maximizing productivity of the well.

DETAILED DESCRIPTION

The present disclosure provides systems and methods for deploying a lower completion string, servicing the well with a treatment fluid down the work string into the completion string, and then closing a valve to fluidically isolate the lower completion string when retrieving the work string. This sequence may now be performed in a single trip, without requiring a further trip with this or another work string to close or reopen the valve. The valve may also include a remote reopening feature to reopen the valve, also without an additional trip, such as to commence production after landing a final completion. An example system includes a connector for releasably connecting the work string with the lower completion string with a mandrel. A ball valve included with the lower completion string remains open while delivering a fluid downhole through the work string and mandrel to service the well. The mandrel is then manipulated to both close the ball valve and to disconnect from the lower completion string.

Figure 1:
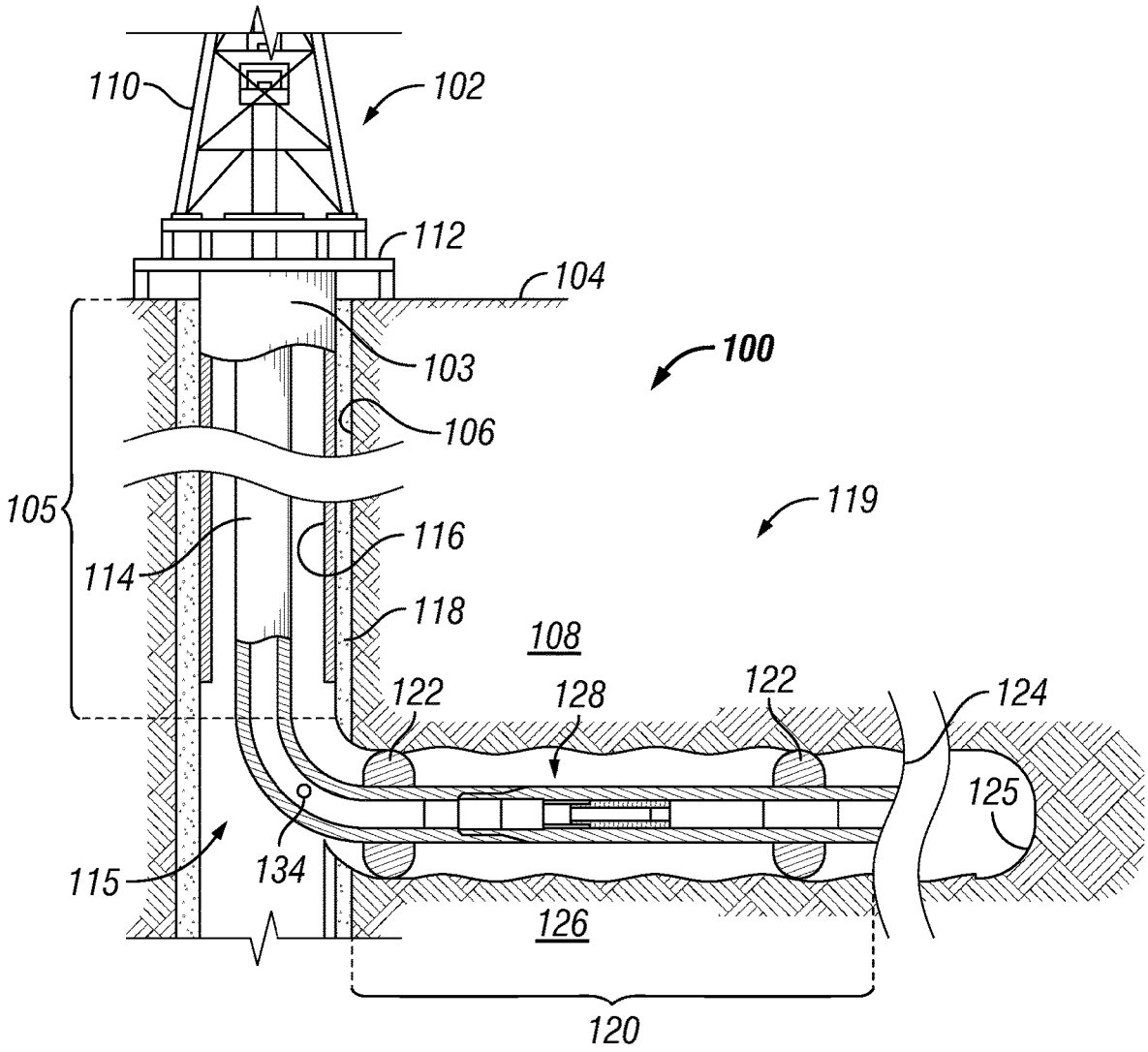
FIG. 1 is an elevation view of an example well system in which a deployment and isolation system may be implemented.

FIG. 1 is an elevation view of an example well system 100 setting forth the general environment and context in which a deployment and isolation system of the present disclosure may be implemented. The well system 100 may include an oil and gas rig 102 arranged at the earth's surface 104 and a wellbore 106 extending therefrom and penetrating a subterranean earth formation 108. The rig 102 may include a large support structure such as a derrick 110, erected over the wellbore 106 on a support foundation or platform, such as a rig floor 112. Even though certain drawing features of FIG. 1 depict a land-based oil and gas rig 102, it will be appreciated that the embodiments of the present disclosure are useful with other types of rigs, such as offshore platforms or floating rigs used for subsea wells, and in any other geographical location. For example, in a subsea context, the earth's surface 104 may be the floor of a seabed, and the rig floor 112 may be on the offshore platform or floating rig over the water above the seabed. A subsea wellhead may be installed on the seabed and accessed via a riser from the platform or vessel.

The derrick 110 or other support structure may be used to help support and manipulate the axial position of a work string 114 such as to raise and lower it within the wellbore 106. The work string (referred to in the art as a landing string in certain contexts) is a tubular string made up of drill pipe, casing, production tubing, or other tubular segments, and having any of a variety of tools for performing wellbore operations, such as drilling, completion, stimulation, or production. The work string 114 may serve various functions, such as to lower and retrieve tools, to convey fluids, and to support the conveyance of communication and/or power during wellbore operations. When a wellbore operation is to be performed, the work string 114 may be progressively assembled on site and lowered into the wellbore 106, i.e. run/tripped into the hole. When a wellbore operation is complete, or when it becomes necessary to exchange or replace tools or components of the work string 114, the work string 114 may be raised or fully removed from the wellbore 106, i.e., tripped out of the hole. In an example of a drilling operation, a drill string may be used to drive rotation of a drill bit, while circulating drilling fluid ("mud") and conveying signals via mud pulse or wired telemetry. In an example of a completion operation, the work string 114 may be used to lower a completion string into the wellbore 106, including intervals of casing, and cement the casing in place. In an example of a formation stimulation operation, proppant-laden fluids used in hydraulically fracturing (i.e., fracking) the formation, or other treatment fluids and/or chemicals such as an acidizing treatment, may be circulated downhole through a tubular member, such as through a hydraulic fracturing tubing string (i.e. frac tubing string) to stimulate the flow of hydrocarbons from the formation. In an example of a production operation, production tubing may be lowered into the wellbore 106 and coupled to the lower completion string above a production zone, so formation fluids such as oil and gas may be produced to surface.

The wellbore 106 may be drilled according to a wellbore plan and along a desired wellbore path to reach a target formation, to avoid non-desirable formation features, to minimize footprint of the well at the surface, and to achieve any other objectives for the well. The wellbore 106 extends from the heel 103 at surface, where drilling commences, to the toe 125, and may follow any path (the wellbore path) in between. The initial portion of the wellbore 106 is typically vertically downward as the drill string would generally be suspended vertically from the rig 102. Thereafter the wellbore 106 may deviate in any direction as measured by azimuth or inclination, which may result in sections that are vertical, horizontal, angled up or down, and/or curved. The term uphole generally refers to a direction along the wellbore path toward the heel 103 and the term downhole generally refers to a direction toward the toe 125, without regard to whether a feature is vertically upward or vertically downward with respect to a reference point. In the example of FIG. 1, the wellbore path includes an initial vertical section 105, followed by a curved section 115 downhole of the vertical section 105 that transitions from the vertical section 105 to a horizontal or lateral section 120 downhole of the curved section 115. Thus, the vertical section 105 is uphole of the curved section 115 and lateral section 120.

In an embodiment, the wellbore 106 may be at least partially cased with a casing string 116 or may otherwise remain at least partially uncased. The casing string 116 may be secured within the wellbore 106 using, for example, cement 118. In other embodiments, the casing string 116 may be only partially cemented within the wellbore 106 or, alternatively, the casing string 116 may be entirely uncemented. The work string 114 may be coupled to a completion assembly 119 that extends into a generally horizontal branch referred to as a lateral section 120 of the wellbore 106. As illustrated, the lateral section 120 may be an uncased or "open hole" section of the wellbore 106.

There are specific reasons why the lateral section 120 may be formed. For example, in a multilateral application, a vertical wellbore may first be drilled traversing multiple productive zones at different vertical depths, and a lateral section may be drilled to each productive zone to maximize production. Another example is steam-assisted gravity drainage (SAGD) applications, in which two parallel lateral sections are drilled, one below the other, and steam is injected into the upper lateral to stimulate the flow of hydrocarbons, assisted by gravity, into the lateral below it. It is noted that although FIG. 1 depicts horizontal and vertical portions of the wellbore 106, the principles of the apparatus, systems, and methods disclosed herein may be similarly applicable to or otherwise suitable for use in wholly horizontal or vertical wellbore configurations. Consequently, the horizontal or vertical nature of the wellbore 106 should not be construed as limiting the present disclosure to any particular wellbore 106 configuration.

The completion assembly 119 may be arranged or otherwise seated within the lateral section 120 of the wellbore 106 using one or more packers 122 or other wellbore isolation devices known to those skilled in the art. The packers 122 may be configured to seal off an annulus 124 defined between the completion assembly 119 and the walls of the wellbore 106. As a result, the subterranean formation 108 may be effectively divided into at least one interval, which may be a pay zone 126. Additional pay zones (not shown) downhole of the at least one interval 126 may also be isolated by packers, and each pay zone may be stimulated and/or produced independently via isolated portions of the annulus 124 defined between adjacent pairs of packers 122. While only one interval 126 is shown in FIG. 1, those skilled in the art will readily recognize that any number of intervals may be defined or otherwise used in the well system 100, without departing from the scope of the disclosure.

The completion assembly 119 may include one or more downhole tools schematically depicted at 128 as arranged in, coupled to, or otherwise forming an integral part of the work string 114. The downhole tools 128 may include, for example, an inflow control device (ICD) for controlling the flow of formation fluids into the lower completion string and uphole through a valve, a frac string for delivering a stimulation fluid downhole through the valve to one or more formation zones to be stimulated, or other tools for servicing the wellbore 106 or lower completion string.

As illustrated, at least one downhole tool 128 may be arranged in the completion assembly 119 in each interval 126, but those skilled in the art will readily appreciate that more than one downhole tool 128 may be arranged therein, without departing from the scope of the disclosure. The downhole tool(s) 128 may include a variety of tools, devices, or machines known to those skilled in the art used in the preparation, stimulation, and production of the subterranean formation 108.

While the downhole tool 128 is shown in FIG. 1 as being employed in an open hole section of the wellbore 106, the principles of the present disclosure are equally applicable to completed or cased sections of the wellbore 106. In such embodiments, the cased wellbore 106 may be perforated at predetermined locations in each interval 126 using any known methods (e.g., explosives, hydrajetting, etc.) in the art. Such perforations serve to facilitate fluid conductivity between the interior of the work string 114 and the surrounding interval 126 of the formation 108.

In order to actuate, trigger, or manipulate the downhole tool 128, one or more wellbore projectile(s) 134 may be introduced into the wellbore 106 and conveyed to the downhole tools 128 to engage or otherwise interact therewith. The wellbore projectiles 134 may include, but are not limited to balls (e.g., "frac" balls), darts, wipers, plugs, or any combination thereof. The wellbore projectiles 134 may be conveyed through the work string 114 and to the completion assembly 119 by any known technique. For example, the wellbore projectiles 134 can be dropped through the work string 114 from the surface 104, pumped by flowing fluid through the interior of the work string 114, self-propelled, conveyed by wireline, slickline, coiled tubing, etc.

Figure 2:
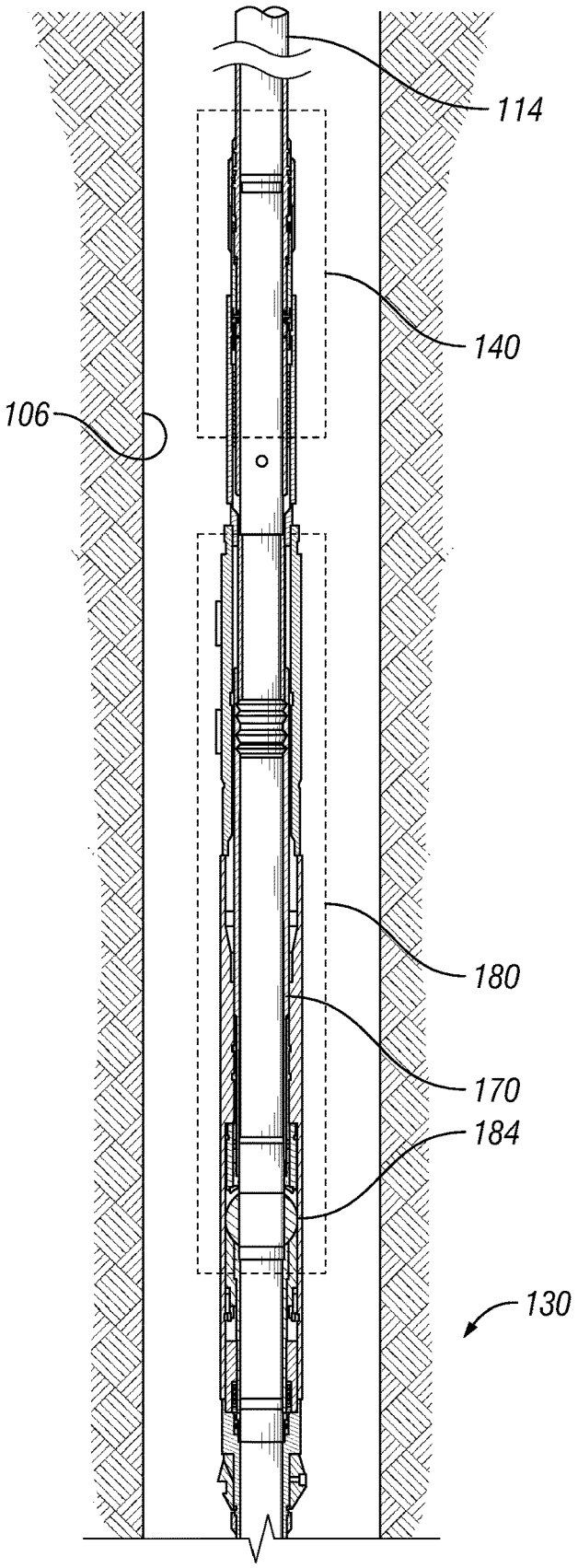
FIG. 2 is a side view of a system for deploying a lower completion string, servicing the well, and then fluidically isolating the lower completion string.

FIG. 2 is a side view of a system for deploying a lower completion string 130, servicing the well, and then fluidically isolating the lower completion string 130, optionally in a single-trip, according to some aspects of this disclosure. The lower completion string 130 may be deployed into the wellbore 106 on the work string 114 of FIG. 1, and landed at a desired location within the wellbore 106. The lower completion string 130 is shown oriented in FIG. 2 as if in a vertical wellbore section, such as when lowering or landing the lower completion string 130 in the vertical section 105 of the wellbore 106 in FIG. 1. However, the lower completion string 130 may be run further downhole and landed in the lateral section 120 of FIG. 1.

A connector is outlined in dashed line type at 140. The connector 140 and its operation are further discussed below in relation to FIG. 3A. Below the connector 140 is a ball valve section outlined in dashed line type at 180. The ball valve section 180 and its operation are further discussed below in relation to FIGS. 4-9. The connector 140 is used in tripping and deploying the lower completion string 130 downhole on the work string 114, and subsequently disconnecting from the lower completion string 130. The ball valve section 180 is closed upon disconnect from the lower completion string 130, to fluidically isolate the lower completion string 130 from the wellbore 106 above the lower completion string 130.

More particularly, the ball valve section 180 includes a ball valve 184 and a sleeve 170 coupling a lower end of the mandrel 142 to the ball valve 184. The ball valve 184 may be alternately closed and opened in response to reciprocation of the mandrel 142. That is, the valve may closed in response to movement of the mandrel in one direction and, optionally, may reopen in response to movement of the mandrel in another direction. Generally, the one direction and the other direction may be, but are not required to be, opposite directions. The one direction and the other direction may be, but are not required to be, linear directions. That is, some axial movement, rotational movement, or combination thereof may be used to close the ball valve and some other axial movement, rotational movement, or other combination thereof may be used to open the ball valve. However, in this particular example, the valve is closed by axial movement of the mandrel in one direction and opened by axial movement of the mandrel in another, opposite direction. The ball valve 184 may initially be open while the lower completion string 130 is run into the wellbore 106 (i.e. as run in hole). The mandrel 142 may be manipulated, such as axially in the disclosed examples or rotationally in alternate examples according to any of a variety of connection types discussed below, to both disconnect from the lower completion string 130 and close the ball valve 184. Thus, movement of the mandrel with respect to other components or relative to the ball valve 184 may result in both disconnection from the lower completion string 130 and to close the ball valve 184, and thereby isolate the lower completion system 130. This allows for a single-trip deployment and isolation of the lower completion string 130, i.e., without having to trip the work string 114 out of the wellbore 106 or trip some other tool on coil tubing or wireline to isolate the lower completion string 130.

Figure 3A:
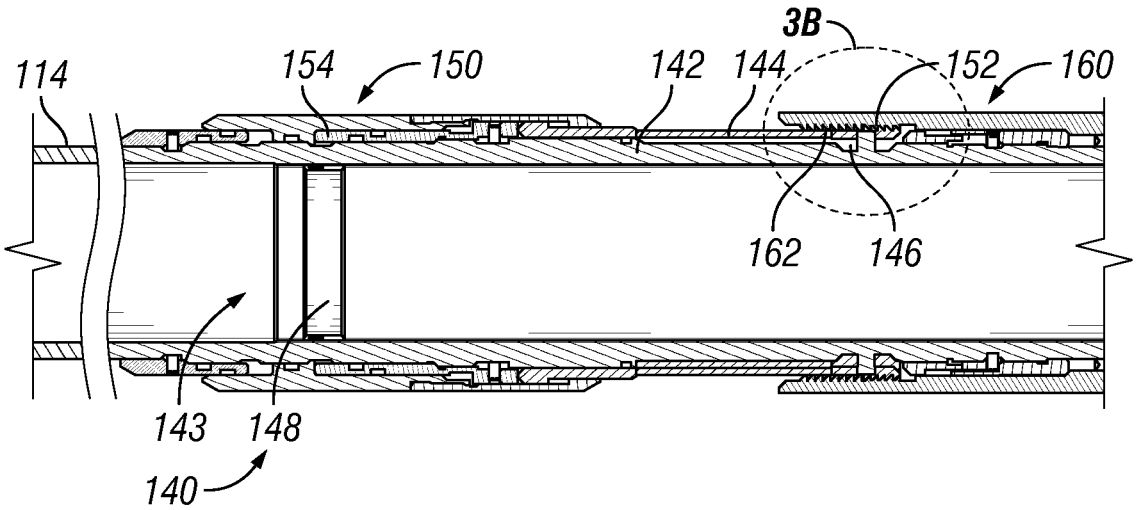
FIG. 3A is an enlarged, detailed view of the connector of FIG. 2.

FIG. 3A is an enlarged, detailed view of the connector 140 of FIG. 2. The connector 140 is oriented ninety degrees counter-clockwise in FIG. 3A with respect to its orientation in FIG. 2, corresponding with the orientation of the connector 140 when positioned in a horizontal, lateral section as described in FIG. 1. For reference, a small portion of the work string 114 is shown extending to the left (uphole of) the connector 140, and of the lower completion string 130 extending to the right (downhole of) the connector 140. The connector 140 comprises a releasable connection mechanism for initially supporting the weight of the lower completion string 130 on the work string 114 when tripping and deploying the lower completion string 130 in hole, and subsequently disconnecting from the lower completion string 130 to release the work string 114 and then trip the work string 114 out of the hole.

Any suitable connection type may be used for supporting the lower completion string 130 on the work string 114 when tripping downhole and subsequently releasing from the lower completion string 130, and the specific details that follow are provided merely by way of example. The releasable connection mechanism in FIG. 3A includes an uphole portion 150 releasably connected with a downhole portion 160. The uphole portion 150 is uphole of the downhole portion 160, such that on separation, the uphole portion 150 would be retrieved with the rest of the work string 114 and the downhole portion 160 would remain downhole with the lower completion string 130. The mandrel 142 of the connector 140 has a flow passage (mandrel bore) 143 that, while connected, allows for conveying fluids downhole through the work string to the lower completion string 130, and for conveying any fluids uphole from the lower completion string 130 to surface.

The uphole portion 150 in this example is a male connector and the downhole portion 160 is a female connector. A collet 144 on the uphole portion 150 is disposed around the mandrel 142. The collet 144 includes an outer engagement structure 152 to releasably engage with a corresponding inner engagement structure 162 on the downhole portion 160. One of the engagement structures 152 and 162 may include teeth, and the other one of the engagement structures 152 and 162 may include corresponding teeth or a threaded surface. In this example, the outer engagement structure 152 comprises teeth formed on an outer surface at an end of the collet 144, and the inner engagement structure 162 comprises threads formed on an inner surface of the downhole portion 160. The collet 144 is radially flexible, though certain features of the connector 140 are designed to prevent the collet 144 from flexing inwardly when connected to prevent inadvertent disconnection.

This arrangement of cooperating teeth on one member with teeth and/or threads on the other member optionally provides a ratchet-latch ("ratch-latch") type of engagement, whereby as the uphole portion 150 is gradually moved axially into the downhole portion 160 to reach the position shown in FIG. 3A, the teeth on one may advance one-by-one past the individual threads or teeth on the other. When advancing to each successive tooth position, the collet 144 radially flexes inward for the teeth on the outer engagement structure 152 to advance past the crests of respective teeth on the inner engagement structure 162, and back outward into the roots (recesses between teeth) in order for the teeth to re-engage so the uphole portion 150 remains connected to the downhole portion 160.

Any of a variety of release structures or operations may be used to separate the uphole portion 150 from the downhole portion 160, such as to disconnect the work string 114 after landing the lower completion string 130. In this ratch-latch connection example, such a release mechanism may be used to flex the collet 144 radially inwardly for the engagement structures 152 and 162 to disengage from each other. The collet 144 may include a plurality of fingers not shown to facilitate flexing. One or more recess 146 may be formed between the collet 144 and the mandrel 142, such as by having the recess 146 formed on an outer surface of the mandrel 142, to provide clearance for the collet 144 to deflect and bend radially inwardly. When the collet 144 is flexed inwardly sufficiently that the teeth or threads on the outer engagement structure 152 clear the teeth or threads on the inner engagement structure 162 the collet 144 may be able to move axially with respect to the mandrel 142. This may allow the uphole portion 150 to be separated from the downhole portion 160, subject to other optional retention features such as shear members.

Shear members may also be implemented in various functionality of this system, such as part of a release mechanism for disconnecting the uphole portion 150 from the downhole portion 160. A shear member is a sacrificial member designed to fail above a threshold level of force. Shear members are typically sheared in response to an applied tensile load but could be alternatively configured to fail in response to an applied torque. The tensile force and/or torque may be applied to or by the mandrel or by the work string, for example. Generally, shear members are used to prevent some function until the shear member has first been failed. In the case of the connector 140, shear members may be used to enable operation of the release mechanism, as also described below.

Figure 3B:
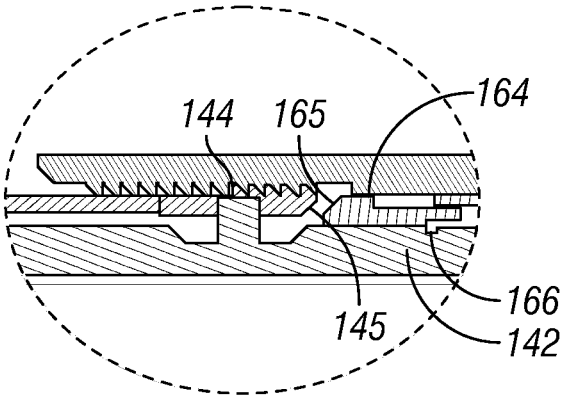
FIG. 3B is a detailed view of the connector taken at section "3B" of FIG. 3A illustrating example features of the releasable connection mechanism.

FIG. 3B is a detail view of the connector 140 taken at section "3B" of FIG. 3A illustrating example features of the releasable connection mechanism according to one or more embodiments. The connector 140 includes a ring housing 164 positioned about the mandrel 142. A ramped surface 165 at the end of the ring housing 164 initially engages a corresponding ramped surface 145 on an abutting edge of the collet 144, to urge or otherwise retains the collet 144 radially outwardly, thereby restricting movement of the collet 144 radially inwardly. A shear member, such as a shear ring 166, is positioned between the mandrel 142 and the ring housing 164 and prevents, up to a certain threshold force, axial movement between mandrel 142 and the ring housing 164. Through any of a variety of mechanisms such as mechanical or hydraulic actuators within the work string or the connector itself, the mandrel 142 may be actuated to apply an axial force to the ring housing 164, in excess of a threshold axial force, to shear the shear ring 166 and thereby enable the ring housing 164 to move axially with respect to the mandrel 142. With the ring housing 164 moved downwardly, the collet 144 then has clearance to move radially inwardly and disconnect the work string, via the uphole portion 150 of the connector 140 in FIG. 3A, from the lower completion string 130, via the downhole portion 160 of the connector 140.

A "pull to release" operation is one way a connector may be configured to disconnect, to release the work string 114 from the lower completion string 130. The release operation described in FIG. 3B is an example of a pull to release mechanism wherein a tensile load is applied to shear one or more shear members before the work string 114 is pulled upward to fully disconnect. However, a pull to release is not limited to the specific structure in FIG. 3B. An alternative example is having one or more shear members (e.g. between the mandrel 142 and downhole portion 160 of the connector 140) configured to support the weight of the lower completion string 130, and release by pulling up on the work string 114 with some threshold level of force required to fail the shear member(s). A pull to release operation is desirable in that it may be performed with a relatively simple motion by manipulation of the work string, mandrel, or other axially-movable member.

An alternative, "rotate to release" operation is also enabled by the example connector in FIGS. 3A and 3B. A rotate to release operation generally involves rotating some member relative to another in order to release the work string 114 from the lower completion string 130. Specifically in FIG. 3A and 3B, the work string 114 may be rotated to unthread the teeth on the outer engagement structure 152 on the collet 144 from the threads on the inner engagement structure 162 of the connector's downhole portion 160. This rotation is to the left so as not to break apart tubing connections. The lower string is anchored by packers, so the mating teeth and threads will thread apart. A rotate to release operation is desirable in that it may also be performed with a relatively simple motion, e.g. by rotation of the work string 114.

A "soft release" mechanism is yet another type of release operation enabled by the example connector in FIGS. 3A and 3B. Referring again to FIG. 3A, an internal ball seat 148 is optionally defined in the mandrel bore 143 for capturing a drop ball 149 (see also FIG. 1) to block flow through the mandrel bore 143. Thereafter, pressure may applied from surface to release the uphole portion 150 of the connector 140 from the downhole portion 160. In this example, the pressure will move a piston 154 to the left. This will lock the collet 144 in place and will not allow it to shoulder on the shear ring 166 anymore. Then, pulling the work string 114 from surface will allow the collet 144 to disengage with relatively little force. In the illustrated examples, all three of these release methods (pull to release, rotate to release, and soft release) are redundant to each other, in case one fails.

Having discussed a relatively complex connector with redundant release mechanisms, it should be appreciated that alternate connectors including simpler designs are also within the present scope. For example, an alternative and potentially simpler connector type may use a polished bore seal assembly (PSA) in combination with a polished bore receptacle (PBR). In comparison with the connector of FIGS. 3A and 3B, the PSA may have a collet only (besides the seals). The PSA may shoulder on something solid (not shearable) if implemented as a rotate to release type mechanism. If implemented as a shear to release mechanism, the connector may have shear screws or other shear member between mandrel and receptacle.

It should be understood, again, that the foregoing connector details and discussion are merely an example of a releasable connection that can support the weight of the lower completion string 130 when tripped into hole, and that has a mandrel that is initially coupled to a valve and is removed from the valve upon disconnect. This connector may comprise any other suitable connector that is releasable but can support the weight of the lower completion string 130 when tripped into hole, and that has a mandrel that can be used to both close the valve and disconnect from the lower completion string 130.

In any of the various embodiments according to this disclosure, regardless of the specific connector or release mechanism chosen, a mandrel included with the connector may be coupled to a valve connected below the connector. Upon release, the mandrel is removed from at least a portion of the valve section along with the work string and portion of the connector above the valve, leaving the valve downhole with the lower completion string and closing the valve. The valve is thereby used to fluidically isolate the lower completion string from the wellbore above the valve after the work string is retrieved. The valve serves as a fluid loss device in that aspect, to prevent fluid loss downhole, which may avoid the need for a fluid loss control material downhole, such as marbles or calcium carbonate (CaCO3), which materials are generally understood in the art apart from the specific teachings of this disclosure. A further aspect is that the valve can later be reopened from the surface, such as by application of fluid pressure downhole without the need for intervention via coil tubing or wireline to reopen the valve. In examples discussed herein, the valve is a ball valve. However, any type of valve having a moveable closure element that can be configured to be closed by the mandrel in conjunction with disconnecting from a lower completion string according to aspects of this disclosure.

Figure 4:
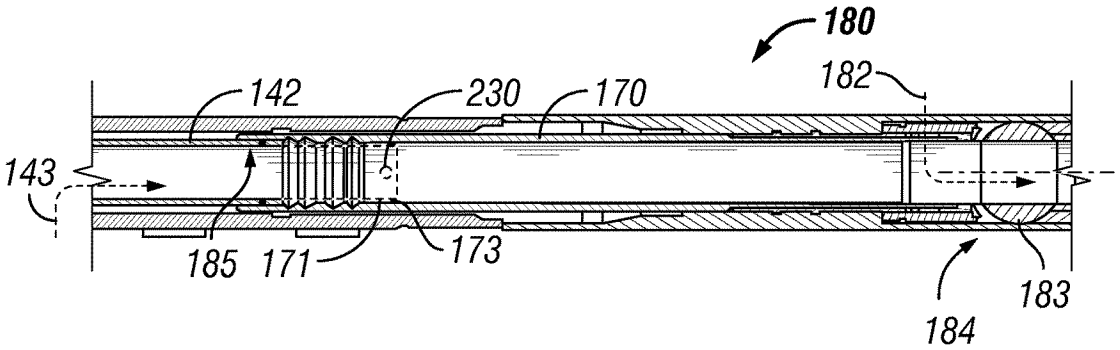
FIG. 4 is a detailed view of an embodiment of the ball valve section while connected downhole of the connector.

FIG. 4 is a detailed view of an embodiment of the ball valve section 180 as connected downhole of the connector 140 of FIGS. 2 and 3. For ease of illustration, the ball valve section 180 is oriented ninety degrees counter-clockwise in FIG. 4 with respect to its orientation in FIG. 2, corresponding with the orientation of the ball valve section 180 when positioned in a horizontal, lateral section as described in FIG. 1. The ball valve 184 includes a valve bore 182 in fluid communication with the mandrel bore 143 when the ball valve 184 is open, i.e., with a ball 183 of the ball valve 184 in an open position. The valve bore 182 defines a bore axis. In FIG. 4 the ball 183 is in what may be described as a fully open position, wherein the bore axis of the ball 183 is generally aligned with an axis of the sleeve 170 and mandrel 142. The ball 183 is an example of a valve closure element that is rotatable or pivotable between a fully open position as shown in FIG. 4, or an intermediate open position wherein the ball 183 is partially rotated, in either case allowing at least some fluid flow through the valve bore 182, and a closed position (e.g. FIG. 5) that closes flow through the valve bore 182. As further discussed below, the ball valve 184 is capable of being closed and optionally reopened by axial reciprocation of the mandrel 142 to axially shift a sleeve 170.

The mandrel 142 and sleeve 170 may be mechanically connected initially, such as using shear screws, a collet, or other separable connection generally indicated at 185. The collet, shear screws, or other separable connection 185 are sufficient to allow the mandrel 142 to shift the sleeve 170 to alternately open or close the ball valve 184. Said sleeve 170 in this example would close the ball 183 when pulled up by the mandrel 142 and, optionally, reopen the ball when pushed down by the mandrel 142. Thus, the mandrel 142 may be manipulated withing a certain amount of force to shift the sleeve 170 and close the ball valve 184 via the sleeve 170 with the separable connection 185 remaining intact. Then, when desired, the mandrel may be manipulated with an additional amount of force and/or displacement, axially or optionally rotationally, to separate from the sleeve 170 at the separable connection 185 and also to disconnect from the lower completion string 130.

A burst disk 230 is also shown in FIG. 4 for use in a remote re-opening mechanism discussed further below. The burst disk 230 may be covered and fluidically isolated from tubing pressure when run into the well and prior to retrieving the work string and mandrel 142. This helps protect against possible premature activation of the burst disk when performing a service operation such as fracking, so the frack pressure does not reach the burst disk 230 until the mandrel 142 is removed. In this example, a mandrel extension 171 is shown in dashed linetype in FIG. 4, extending part way into the sleeve 170 to cover a burst disk 230. The mandrel extension 171 may be unitarily formed with the mandrel 142, or a separate tubular extension secured at one end to the mandrel 142. A sealing element 173 such as an o-ring seals between the mandrel extension 171 and the sleeve 170 to isolate the burst disk 230 from pressure from the fracking or other service operation.

The ball valve 184 may be run into the wellbore in the open position and remain open to deliver fluid during a service treatment. Alternatively, the ball valve 184 may be run into the wellbore in the closed position and opened by manipulation of the mandrel 142 and coupled sleeve 170 prior to the service treatment. Holding the ball valve 184 open while the work string is connected allows fluids such as stimulation treatments to be supplied downhole through the work string into the lower completion string, and formation fluids to be produced from the lower completion string and up through the work string to surface. For example, the service operation may include hydraulic fracturing, in which a proppant-laden fluid is delivered downhole through the open ball valve 184 as in FIG. 4.

After fracking or other service operation is completed, the work string may be disconnected from the lower completion string and retrieved. Before retrieving the work string, the ball valve is first closed. The disconnecting and closing of the ball valve may both be performed by manipulation of the mandrel. The ball valve is preferably closed when disconnecting from the lower completion string 130, i.e., after the service operation is finished but before or concurrently with disconnecting. The mandrel 142 may initially be pulled up to close the ball valve 184 to prevent fluid loss to the formation. Then, the mandrel may be moved further and/or with greater force to break the connection between the mandrel 142 and ball sleeve 170 at the separable connection 185 such as by the shear screws shearing or the collet snapping. The work string and lower completion string are then separated either by a straight pull to release, rotate to release, or drop a ball and pressure (soft) to release, as described above. When the connector 140 is disconnected and the mandrel 142 is removed, the ball valve 184 remains closed, such as illustrated in FIG. 5, to isolate the wellbore below the ball valve 184 from the rest of the wellbore above it.

Figure 5:
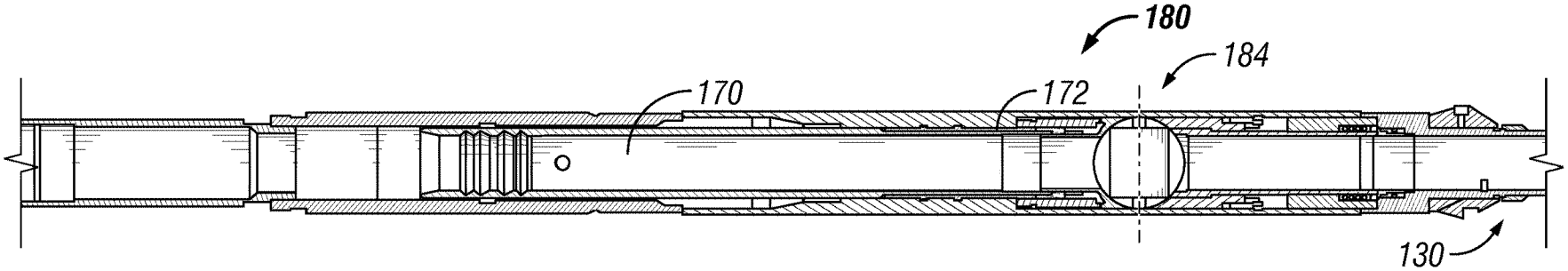
FIG. 5 is a detailed view of the ball valve section of FIG. 4, after the mandrel has been used to close the ball valve, separate from the sleeve, and disconnect the work string along with the mandrel.

FIG. 5 is a detailed view of the ball valve section 180 of FIG. 4, after the mandrel (FIG. 4) has been moved axially to shift the sleeve 170 to the left (uphole) to close the ball valve 184, then further to separate the mandrel from the sleeve 170, disconnect the work string, and remove the mandrel along with it. In this embodiment, the sleeve 170 is coupled to the mechanism of the ball valve 184 via one or more actuator arm 172 as further discussed below in FIGS. 6 and 7. With the sleeve 170 shifted to the left, the actuator arm 172 has correspondingly moved left/uphole to close the ball valve 184, as can be seen from the rotated position of the ball 183 of the ball valve 184. The closed ball valve 184 now fluidically isolates an interior of the lower completion string 130 from the wellbore 106 above the lower completion string 130. The ball valve 184 generally operates as a two-way valve that, when open, allows flow in either direction (either downhole or uphole), and when closed, blocks flow in both directions (uphole and downhole). Thus, the closed ball valve 184 may block the flow of fluid above the closed ball valve 184 from flowing downhole through the ball valve 184 and may block the flow of formation fluid uphole through the ball valve 184.

Figure 6:
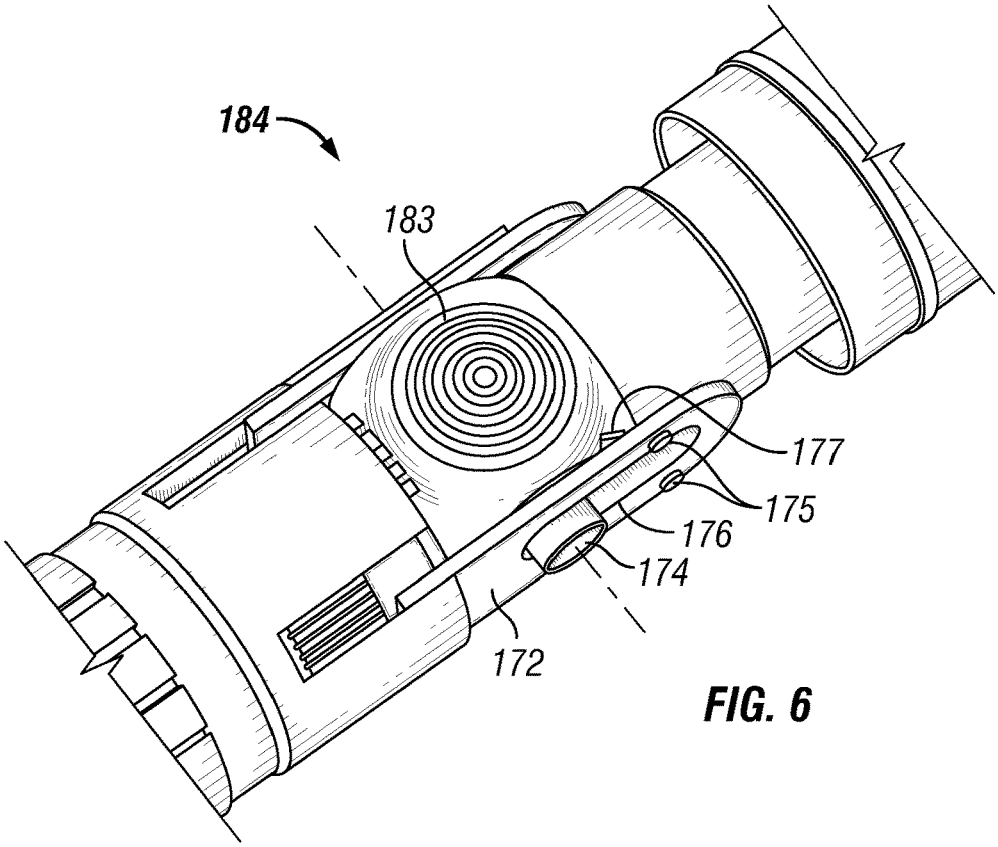
FIG. 6 is a perspective view of an example embodiment of the ball valve in the open position corresponding to FIG. 4.

FIG. 6 is a perspective view of an example embodiment of the ball valve 184 in the open position corresponding to FIG. 4. The ball 183 is pivotable about a pivot mount 174. The actuator arm 172 has a slot 176 that a portion of the pivot mount 174 rides in to limit travel of the actuator arm 172 (and sleeve) with respect to the ball 183. For example, the endpoints of the slot 176 may correspond to closed and fully open positions of the ball 183. To pivot the ball between open and closed positions, the actuator arm 172 may engage a periphery of the ball 183, such as with one or more cooperating engagement members 175, 177 on the actuator arm 172 and ball 183, respectively. The actuator arm 172 may be driven left to engage the ball 183 and open the ball valve 184, and to the right to close the ball valve 184.

Figure 7:
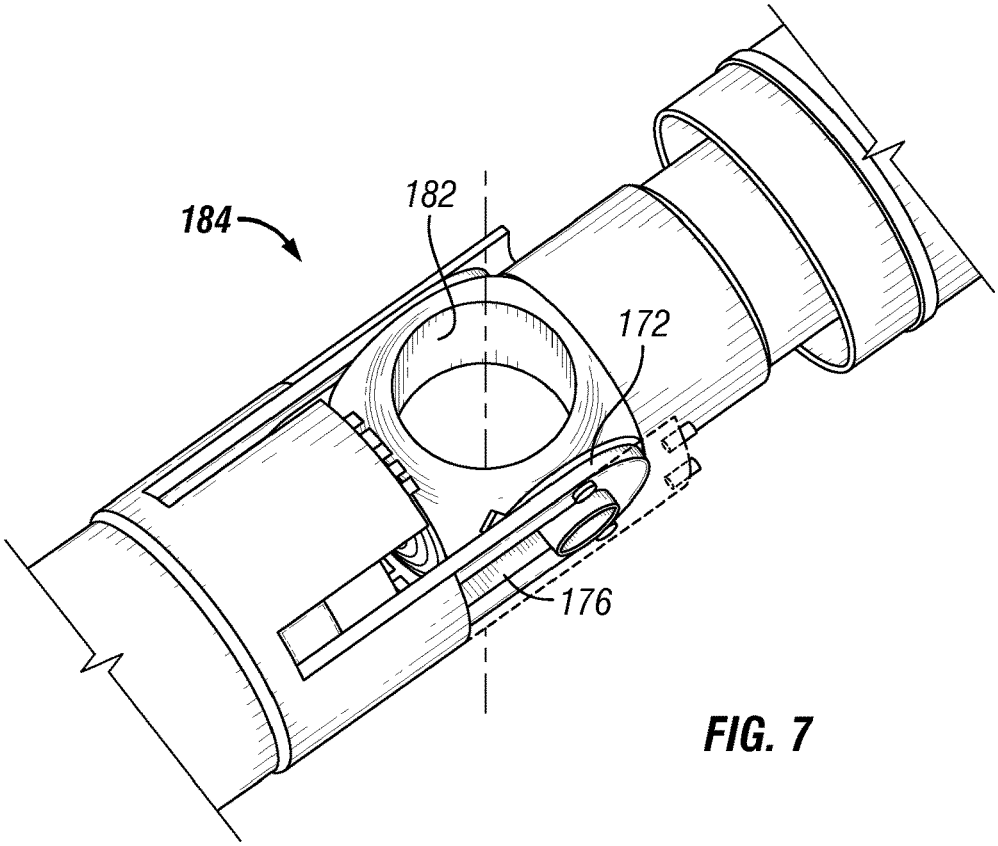
FIG. 7 is a perspective view of the ball valve moved to the closed position corresponding to FIG. 5.

FIG. 7 is a perspective view of the ball valve 184 of FIG. 6 moved to the closed position corresponding to FIG. 5. The actuator arm(s) 172 is now moved fully to the left within the constraint of the slot 176. The axis of the ball's bore 182 is also now generally perpendicular to an axis of the sleeve and mandrel (not shown) to close off flow through the valve 184. Thus, FIGS. 4 and 5 provide an example of how axial reciprocation of the mandrel and corresponding shifting of the sleeve can be used to alternately open and close the ball valve 184. It should be understood, however, that any of a variety of other mechanical configurations are within the scope of this disclosure, wherein the mandrel can be manipulated by some axial movement, rotational movement, or combination thereof, to control the ball valve 184.

Figure 8:
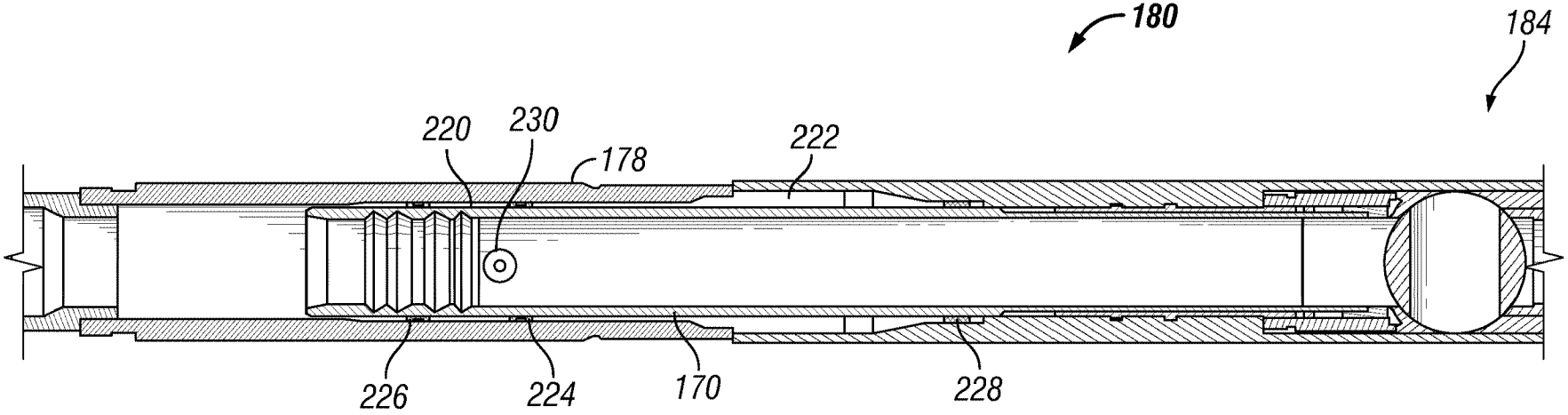
FIG. 8 is a side view of the ball valve section after the mandrel has been removed and the sleeve shifted to close the ball valve.
Figure 9:
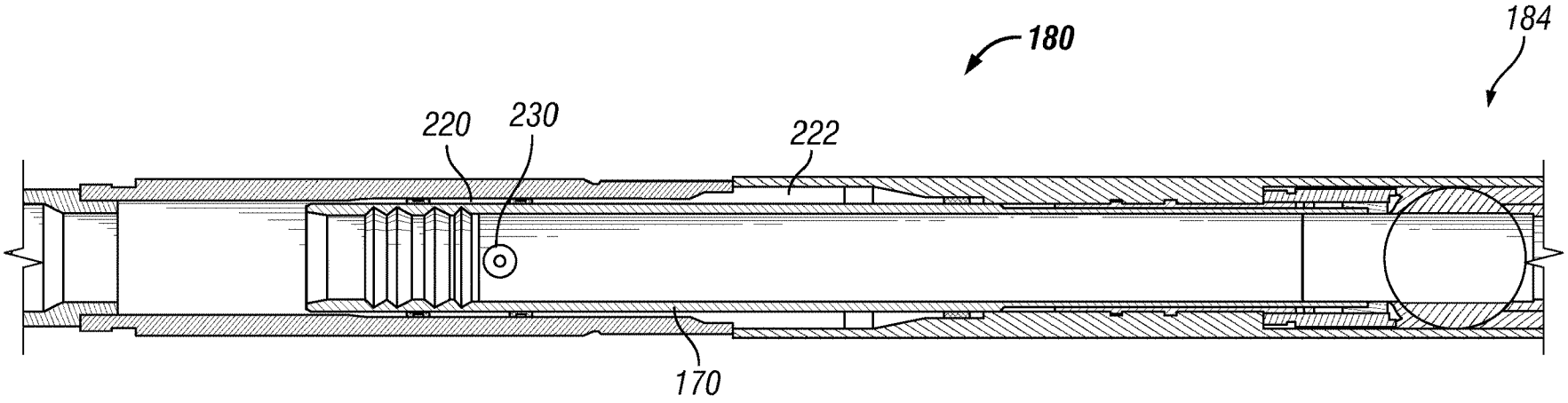
FIG. 9 is a side view of the ball valve section after the burst disk has been burst to remotely reopen the valve.

FIGS. 8 and 9 illustrate an example embodiment of a remote-reopening mechanism for remotely reopening the ball valve at some later time after the work string has been retrieved to surface, such as after a final completion is landed. The remote reopening mechanism is remote in that it allows the ball valve 184 to be reopened after the work string has been retrieved, and without necessarily tripping another tool such as a wireline or coiled tubing downhole. Generally, a remote-reopening mechanism includes a pressure sensitive element responsive to application of a threshold fluid pressure to urge the ball valve back to an open position after the work string has been retrieved. A variety of configurations are possible, among which FIGS. 8 and 9 are an example.

FIG. 8 is a side view of the ball valve section 180 after the mandrel has been removed and the sleeve shifted upward to close the ball valve 184. The burst disk 230 may also now be exposed to internal pressure, with the mandrel extension 171 of FIG. 4 having been removed. The remote reopening mechanism in this example includes two sealed chambers 220, 222 around the sleeve 170 that allow the sleeve 170 to be operated as a piston responsive to any differential pressure between those two chambers 220, 222. The chambers may be configured in a variety of ways within the scope of this disclosure. In the illustrated example, a first seal 224 locked on the sleeve 170 seals between the outer diameter (OD) of the sleeve 170 and an inner diameter (ID) of a housing 178 of the ball valve section 180, creating a sort of partition between the two chambers 220, 222. A second seal 226 is locked to the housing 178 above the first seal 224, and a third seal 228 is locked to the housing 178 below the first seal 224. Thus, the first chamber 220 is defined between the sleeve 170 and housing 178 and between the first and second seals 224, 226, and the second chamber 222 is defined between the sleeve 170 and housing 178 and between the first and third seals 224, 228. The two chambers 220, 222 are each run in at equal pressure, e.g., both at atmospheric pressure, so there is initially no differential pressure between the chambers 220, 222. The pressure sensitive element in this embodiment includes a burst disk 230 on the sleeve 170 configured to burst in response to a threshold pressure. In particular, the burst disk 230 may comprise a membrane covering an opening to the first chamber 220. When the ball valve 184 needs to be reopened, fluid pressure may be applied such as by supplying pressurized fluid downhole from the surface (or from any other available pressure source) to burst the membrane of the burst disk 230.

FIG. 9 is a side view of the ball valve section 180 after the burst disk 230 has been burst to remotely reopen the valve 184. Bursting the burst disk 230 allows the pressure to enter that first chamber 220, while the other chamber 222 remains at its original pressure, e.g., atmospheric pressure. This creates a differential pressure between the first chamber 220 and second chamber 222 that urges the sleeve 170 downward, reopening the ball valve 184.

It should be understood that FIGS. 8-9 illustrate just one example configuration of such a remote-reopening mechanism. Any other fluid-responsive release mechanism for remotely reopening a valve is considered within the scope of this aspect of the disclosure. This may be combined with any number of other features disclosed, including but not limited to a ball valve that may be reopened by remote application of fluid pressure and/or a sleeve that is shiftable by remote application of fluid pressure to reopen a ball valve, whether using a burst disk or any other mechanical actuator responsive to fluid pressure.

Figure 10:
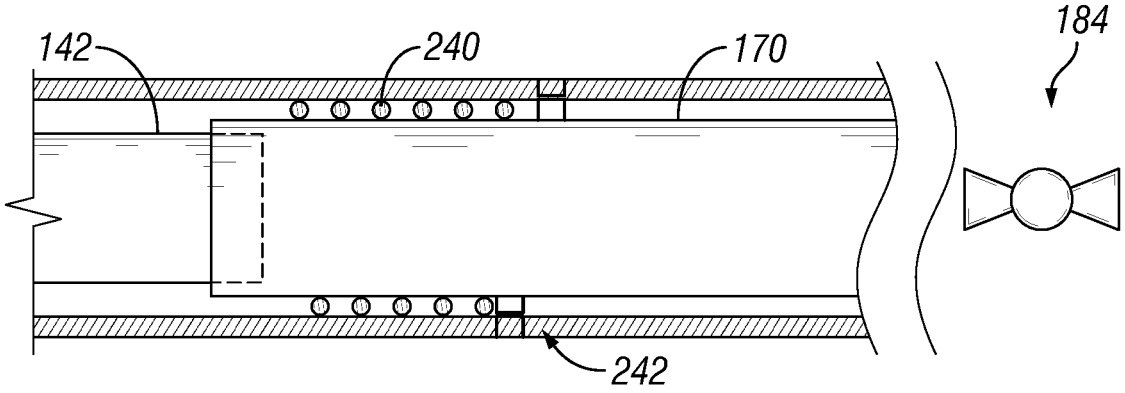
FIG. 10 is a schematic diagram of another example of a remote reopening mechanism using a spring-biased sleeve.

FIG. 10 is a schematic diagram of another, non-limiting example of a remote reopening mechanism, wherein a spring 240 may be included to bias the sleeve 170 in a direction (e.g., downhole and to the right) that would open the ball valve 184. To reach the position in FIG. 10, the mandrel 142 may urge the sleeve 170 to the left, against the biasing action of the spring 240, to initially close the ball valve 284 when disconnecting the work string. Disconnecting from the work string may typically occur after completing a service operation involving delivery of fluid downhole. Thus, when disconnecting from the work string, the closing of the ball valve may occur after the service operation but prior to or concurrently with the step of disconnecting the work string. A catch 242 may be provided to catch the sleeve 170 after being moved by the mandrel to the left to close the ball valve 184. The catch 242 may include any element(s), e.g. shear members, spring-loaded pins, etc., that can temporarily hold the sleeve 170 against the biasing action of the spring 240 and maintain the ball valve 184 in the closed position until it is desired to remotely reopen the valve 184. The pressure sensitive element in this example may include the elements of the sleeve 170 and/or valve 184 that will overcome the catch 242 to release the sleeve 170 in response to a threshold fluid pressure. When it is desired to reopen the ball valve 184, fluid pressure may be supplied downhole at or above the threshold pressure until the catch 242 is overcome, e.g., until shear members fail, thereby releasing the sleeve 170. The sleeve 170 is then shifted back toward the right (which may be referred to as the open position of the sleeve) by the spring 240 to reopen the ball valve 184.

Having set forth the various example features of the disclosed system including the connector and valve and how they cooperate, it can be seen that the principles of this disclosure now make it possible for a lower completion system to be deployed and isolated in a single trip. In particular, the lower completion string can be deployed on a work string, landed downhole, optionally with the valve already in an open position, so that service operations can be performed by the work string. The service operations may involve the delivery of fluids to or from the lower completion string. Then, in the same trip, the closing of the valve may occur when (i.e., prior to or concurrently with) disconnecting the work string to isolate the wellbore below the valve. This enables a variety of wellbore operations to be performed in a single trip and ensure the valve is closed when retrieving the work string.

In various wellbore services, tripping the work string downhole to land the lower completion string with the valve initially open facilitates the delivery of fluids while performing the service. In one example application, the lower completion string comprises tools for stimulating the formation via delivery of stimulation fluids such as a proppant-laden fracturing fluid or an acidizing treatment downhole. In the example of a ball valve, the ball may be run down in the open position or subsequently opened by the mandrel after tripping downhole. The work string may be used, among other things, to deliver the stimulation fluids through the open valve and perform other functions used during fracturing and other stimulation services. In another example application, the lower completion string comprises an ICD used to help to preferentially produce certain fluids like oil over other fluids like entrapped water out of the formation. The work string may be used, among other things, to apply fluid pressure down through the open ball valve to activate certain tools or processes, such as setting a packer.

After performing the wellbore services, the valve may be automatically closed upon manipulation of the mandrel to remove the work string, to isolate the formation and prevent unwanted migration of fluids. Having the valve close upon removal of the mandrel facilitates isolating the formation to prevent unwanted migration of fluids uphole and/or downhole through the closed valve. A two-way valve may prevent the flow of fluids downhole past the valve and also prevent unwanted flow of fluids uphole, such as formation fluids.

The systems and methods may include any of the various features of the systems and methods disclosed herein, including one or more of the following statements.

Statement 1. A deployment and isolation system, comprising a connector for releasably connecting a work string with a lower completion string to deploy the lower completion string into a well, the connector including a mandrel operable to selectively disconnect the work string from the lower completion string; and a ball valve on the lower completion string initially coupled to the mandrel, such that the mandrel is further operable to close the ball valve when disconnecting the work string from the lower completion string.

Statement 2. The deployment and isolation system of statement 1, further comprising: a sleeve that couples the ball valve to the mandrel; a separable connection initially connecting the sleeve to one end to the mandrel; and wherein the mandrel is moveable to first shift the sleeve to close the ball valve and further to separate the mandrel from the sleeve at the separable connection.

Statement 3. The deployment and isolation system of statement 2, wherein the mandrel is moveable axially to shift the sleeve and/or to separate the mandrel from the sleeve at the separable connection.

Statement 4. The deployment and isolation system of statement 2, wherein the valve is configured to alternately close in response to movement of the mandrel in one direction and open in response to movement of the mandrel in another direction.

Statement 5. The deployment and isolation system of statement 2, further comprising: an actuator arm coupled to the sleeve to the ball valve, wherein the actuator engages a ball of the ball valve to close the ball valve.

Statement 6. The deployment and isolation system of statement 1, further comprising: a valve remote reopening mechanism that includes a pressure sensitive element responsive to application of a threshold fluid pressure and that urges the ball valve back to an open position after the work string has been retrieved.

Statement 7. The deployment and isolation system of statement 6, wherein the valve remote reopening mechanism further includes: an axially shiftable sleeve that couples the ball valve to the mandrel; a first and second fluid chamber about the sleeve; and a burst disk on the sleeve configured to burst in response to the application of the threshold fluid pressure to increase pressure to the first chamber.

Statement 8. The deployment and isolation system of statement 6, wherein the valve remote reopening mechanism further includes: an axially shiftable sleeve that couples the ball valve to the mandrel; a spring biasing the sleeve in a direction that would open the ball valve; and a catch configured for holding the sleeve once the mandrel has closed the ball valve, wherein the catch releases the sleeve in response to the application of the threshold fluid pressure.

Statement 9. A deployment and isolation system, comprising: a connector for releasably connecting a work string with a lower completion string to deploy the lower completion string into a well, the connector including a mandrel operable to selectively disconnect the work string from the lower completion string; a ball valve on the lower completion string, the ball valve operable to control flow to the lower completion string; and a sleeve coupling the ball valve to the mandrel, wherein the sleeve is moveable by the mandrel to close the ball valve when disconnecting the work string.

Statement 10. The deployment and isolation system of statement 9, further comprising: a valve remote reopening mechanism that includes a first and second fluid chamber about the sleeve, and a burst disk on the sleeve configured to burst in response to application of a threshold fluid pressure to increase pressure to the first chamber.

Statement 11. The deployment and isolation system of statement 9, further comprising: a valve remote reopening mechanism including a spring biasing the sleeve to open the ball valve, and a catch configured for holding the sleeve once the mandrel has closed the ball valve, wherein the catch releases the sleeve to reopen the ball valve in response to application of a threshold fluid pressure.

Statement 12. A method of servicing and isolating a well in a single trip, comprising: deploying a lower completion string into a well on a work string, the lower completion string including a ball valve for controlling flow to the lower completion string; with the ball valve initially open, flowing a fluid through a mandrel and the ball valve; and operating the mandrel to both close the ball valve and disconnect the work string from the lower completion string with the ball valve remaining downhole.

Statement 13. The method of statement 12, wherein operating the mandrel to close the ball valve comprises: moving the mandrel to shift a sleeve coupling the mandrel to the ball valve to close the ball valve and further to separate the mandrel from the sleeve.

Statement 14. The method of statement 12, further comprising:

remotely reopening the ball valve by applying at least a threshold pressure to a pressure sensitive element to urge the ball valve back to an open position.

Statement 15. The method of statement 12, further comprising:

remotely reopening the ball valve by applying at least a threshold pressure to a burst disk on a sleeve coupled to the ball valve, to create a pressure differential that shifts the sleeve.

Statement 16. The method of statement 12, further comprising: biasing a sleeve coupled to the ball valve in a direction that would open the ball valve; using the mandrel to shift the ball valve in another direction to close the ball valve; holding the sleeve against the biasing to keep the ball valve closed once the mandrel has closed the ball valve; and applying at least a threshold fluid pressure to release the sleeve to remotely reopen the ball valve.

Statement 17. The method of statement 12, wherein the step of flowing a fluid comprises delivering a stimulation fluid downhole through the mandrel and open ball valve to the lower completion string to stimulate a formation zone.

Statement 18. The method of statement 12, wherein the lower completion string comprises an inflow control device and the step of flowing a fluid comprises receiving a formation fluid separated through the inflow control device.

Statement 19. The method of statement 12, further comprising: landing a final completion; and subsequently applying a fluid pressure downhole to activate a valve remote reopening mechanism to reopen the ball valve.

Statement 20. The method of statement 12, wherein closing the ball valve and disconnecting the work string from the lower completion string are both performed responsive to axial movement of the mandrel.

It should be understood that, although individual examples may be discussed herein, the present disclosure covers all combinations of the disclosed examples, including, without limitation, the different component combinations, method step combinations, and properties of the system.

The compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

All numerical values within the detailed description and the claims herein modified by "about" or "approximately" with respect the indicated value are intended to take into account experimental error and variations that would be expected by a person having ordinary skill in the art.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A deployment and isolation system, comprising:

a connector for releasably connecting a work string with a lower completion string to deploy the lower completion string into a well, the connector including a mandrel operable to selectively disconnect the work string from the lower completion string;

a ball valve on the lower completion string initially coupled to the mandrel, such that the mandrel is further operable to close the ball valve when disconnecting the work string from the lower completion string; and a valve remote reopening mechanism including an axially shiftable sleeve responsive to application of a threshold fluid pressure to urge the ball valve back to an open position after the work string has been retrieved, wherein the valve remote reopening mechanism further comprises a spring biasing the sleeve in a direction that would open the ball valve.

2. The deployment and isolation system of claim 1, further comprising:

a sleeve that couples the ball valve to the mandrel; and a separable connection initially connecting the sleeve to one end to the mandrel, wherein the mandrel is moveable to first shift the sleeve to close the ball valve and further to separate the mandrel from the sleeve at the separable connection.

3. The deployment and isolation system of claim 2, wherein the mandrel is moveable axially to shift the sleeve and/or to separate the mandrel from the sleeve at the separable connection.

4. The deployment and isolation system of claim 2, wherein the valve is configured to alternately close in response to movement of the mandrel in one direction and open in response to movement of the mandrel in another direction.

5. The deployment and isolation system of claim 2, further comprising:

an actuator arm coupled to the sleeve to the ball valve, wherein the actuator engages a ball of the ball valve to close the ball valve.

6. The deployment and isolation system of claim 1, wherein the valve remote reopening mechanism further comprises a catch configured for holding the sleeve once the mandrel has closed the ball valve, wherein the catch releases the sleeve in response to the application of the threshold fluid pressure.

7. A deployment and isolation system, comprising:

a connector for releasably connecting a work string with a lower completion string to deploy the lower completion string into a well, the connector including a mandrel operable to selectively disconnect the work string from the lower completion string;

a ball valve on the lower completion string, the ball valve operable to control flow to the lower completion string;

a sleeve coupling the ball valve to the mandrel, wherein the sleeve is moveable by the mandrel to close the ball valve when disconnecting the work string; and a valve remote reopening mechanism for urging the sleeve back to an open position responsive to application of a threshold fluid pressure after the work string has been retrieved, wherein the valve remote reopening mechanism further comprises a spring biasing the sleeve in a direction that would open the ball valve.

8. The deployment and isolation system of claim 7, wherein the valve remote reopening mechanism includes a catch configured for holding the sleeve once the mandrel has closed the ball valve, wherein the catch releases the sleeve to reopen the ball valve in response to the application of the threshold fluid pressure.

9. A method of servicing and isolating a well in a single trip, comprising:

deploying a valve remote reopening mechanism and a lower completion string into a well on a work string, the lower completion string including a ball valve for controlling flow to the lower completion string, wherein the valve remote reopening mechanism further comprises a spring biasing the sleeve in a direction that would open the ball valve;

with the ball valve initially open, flowing a fluid through a mandrel and the ball valve;

operating the mandrel to both close the ball valve and disconnect the work string from the lower completion string with the ball valve remaining downhole;

biasing a sleeve coupled to the ball valve in a direction that would open the ball valve; and applying a threshold fluid pressure to axially shift the sleeve to remotely reopen the ball valve.

10. The method of claim 9, wherein operating the mandrel to close the ball valve comprises:

moving the mandrel to shift a sleeve coupling the mandrel to the ball valve to close the ball valve and further to separate the mandrel from the sleeve.

11. The method of claim 9, further comprising:

remotely reopening the ball valve by applying at least a threshold pressure to a pressure sensitive element to urge the ball valve back to an open position.

12. The method of claim 9, further comprising:

holding the sleeve against the biasing to keep the ball valve closed until applying the threshold fluid pressure to release the sleeve to remotely reopen the ball valve.

13. The method of claim 9, wherein the step of flowing a fluid comprises delivering a stimulation fluid downhole through the mandrel and open ball valve to the lower completion string to stimulate a formation zone.

14. The method of claim 9, wherein the lower completion string comprises an inflow control device and the step of flowing a fluid comprises receiving a formation fluid separated through the inflow control device.

15. The method of claim 9, further comprising:

landing a final completion; and subsequently applying a fluid pressure downhole to activate a valve remote reopening mechanism to reopen the ball valve.

16. The method of claim 9, wherein closing the ball valve and disconnecting the work string from the lower completion string are both performed responsive to axial movement of the mandrel.

* * * * *